US005615946A

United States Patent [19]

Yeh

[11] Patent Number: 5,615,946

[45] Date of Patent: Apr. 1, 1997

[54] MULTIPURPOSE TREE LAMP

[76] Inventor: John Yeh, 660 S. Aberdeen, Anaheim Hills, Calif. 90266

[21] Appl. No.: 529,573

[22] Filed: Sep. 18, 1995

[51] Int. Cl.[6] ..... F21V 21/14

[52] U.S. Cl. ..... 362/250; 362/388; 362/430; 362/431

[58] Field of Search ..... 362/250, 431, 362/430, 410, 413, 414, 388, 418, 285

[56] References Cited

U.S. PATENT DOCUMENTS

| | | | |
|---|---|---|---|
| 2,793,286 | 5/1957 | Stiffel | 362/431 |
| 2,977,566 | 3/1961 | Neumann et al. | 362/431 |
| 5,124,899 | 6/1992 | Hale | 362/431 |
| 5,221,141 | 6/1993 | Swanson | 362/250 |

FOREIGN PATENT DOCUMENTS

| | | | |
|---|---|---|---|
| 432715 | 7/1935 | United Kingdom | 362/413 |

*Primary Examiner*—Ira S. Lazarus
*Assistant Examiner*—Alfred Basichas
*Attorney, Agent, or Firm*—Francis X. LoJacono

[57] ABSTRACT

A multipurpose tree lamp that is constructed to establish a multipurpose lamp structure which can be readily rearranged to form two independent lamps, wherein one defines a floor type tree lamp and the other defines a table lamp.

3 Claims, 2 Drawing Sheets

MULTIPURPOSE TREE LAMP

BACKGROUND OF THE INVENTION

The present invention relates generally to lamps and more particularly to a floor lamp. This floor lamp is designed to have a dual purpose. First, it provides a plurality of light fixtures that are adjustably mounted along the length of a multi-section lamp post that includes a plurality of pole members or sections defining a multipurpose tree lamp, and second the uppermost pole section is adapted to be removed so as to be separately arranged to define a table lamp having a single pole section and a single light fixture mounted to a second base member when desired.

DESCRIPTION OF THE PRIOR ART

Many types and configurations of floor lamps and more specifically those which are referred to as tree lamps are presently in use. Previously, floor lamps, were usually designed with lamp posts of various designs and diameters, and with light fixtures mounted to the upper free ends of the posts. However, recently there has been introduced a variety of floor lamps that are defined as tree lamps. A tree lamp commonly comprises an upright pole having a diameter of between one and a half inch to approximately 3 inches and on which is mounted a plurality of light fixtures. This arrangement allows the wiring of the floor lamp to be hidden within the tubular pole, whereby the wire generally exits from the bottom of the lamp base. Thus, the light fixtures are generally positioned along the upper portion of the lamp post, that is at least above the midsection of the lamp post. Some lamp fixtures are affixed to the lamp post and are provided with various means to allow the light fixtures to rotate about their fixed attaching point.

SUMMARY OF THE INVENTION

The present invention will hereinafter disclose a new and unique tree lamp that allows an upright floor lamp to be rearranged to not only allow the light fixtures to be rotated about their attaching device but also to be arranged to be slidably positioned along the full length of the lamp post. The lamp is formed with a plurality of individual pole members or sections that are screwed together or otherwise removably secured to each other. Further, each light fixture is provided with independent wiring which is positioned alongside the lamp post. This arrangement allows the uppermost pole section to be removed with one of the adjustable light fixtures which together become a second base member so as to form a second lamp that now defines a table lamp. After the removal of the upper pole section a cap member is secured to the free end of the remaining pole section of the multipurpose tree lamp. Accordingly, the removal of the first pole section and light fixture from the multipurpose tree lamp does not affect the oprablility of the floor lamp since it still includes the remaining adjustable light fixtures.

Therefore, the present invention has for an important object to provide a multipurpose tree lamp that is so constructed as to establish a multipurpose lamp structure which can be readily rearranged to form two independent lamps, wherein one defines a floor-type tree lamp and the other defines a table lamp.

Still another object of the invention is to provide a multipurpose tree lamp that comprises a plurality of interconnecting pole members or sections that are easily assembled without the need of special tools or the need for rearranging the electrical wiring for each individual lamp fixture.

A further object of the present invention is to provide a multipurpose tree lamp that can be readily stored in small sized containers so that one can purchase a lamp of this type and assemble it at home without special tools.

Still another object of the invention is to provide a multipurpose tree lamp which has a simple arrangement so that one can either assemble the tree lamp as a single floor lamp having a plurality of light fixtures or as two lamps consisting of a floor type tree lamp and a second matching table lamp using a pole section and one of the lamp fixtures taken from the basic multipurpose tree lamp.

Still a further object of the present invention is to provide a multipurpose tree lamp of this character that is easy to assemble, relatively inexpensive to manufacture, and simple to ship.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 4:
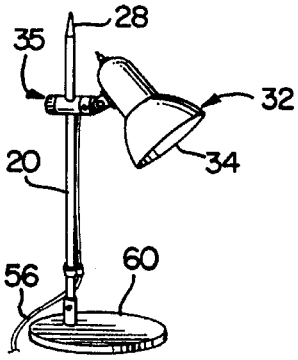
FIG. 4 is a pictorial view of a table lamp that is made up from the upper pole section removed from the multipurpose tree lamp on which is mounted a light fixture.
Figure 1:
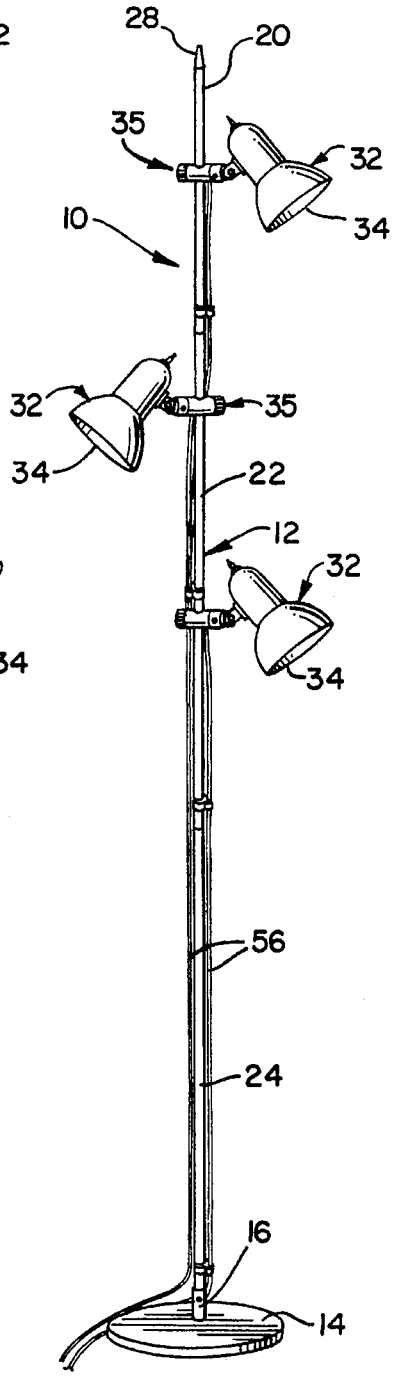
FIG. 1 is a pictorial view of the multipurpose tree lamp of the present invention.

Referring more particularly to FIG. 1, there is shown a pictorial view of a multipurpose tree lamp, generally indicated at 10, which defines a floor lamp as opposed to a table lamp, which is illustrated in FIG. 4, and in itself is formed from the parts taken from the multipurpose tree lamp structure of FIG. 1, as will hereinafter be described.

Accordingly, the multipurpose lamp 10 defines a floor type lamp 10, which is herein referred, to as a tree lamp, having a lamp post 12 that is removably mounted to a base member 14. A nipple 16 having an internally threaded bore 18 is fixedly secured to the base member 14 (See FIG. 6.), whereby lamp post 12 is removably mounted therein. Lamp post 12 is formed with a plurality of pole members and is illustrated as having three pole sections.

Figure 2:
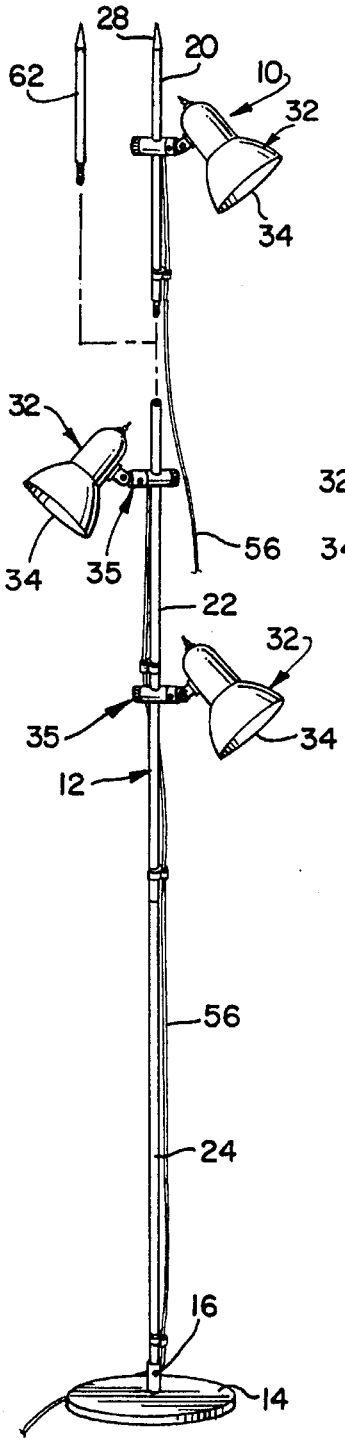
FIG. 2 is a pictorial view of the multipurpose tree lamp showing the first pole section along with a light fixture removed from the floor lamp structure and a cap member which is used to replace the disconnected pole section.
Figure 3:
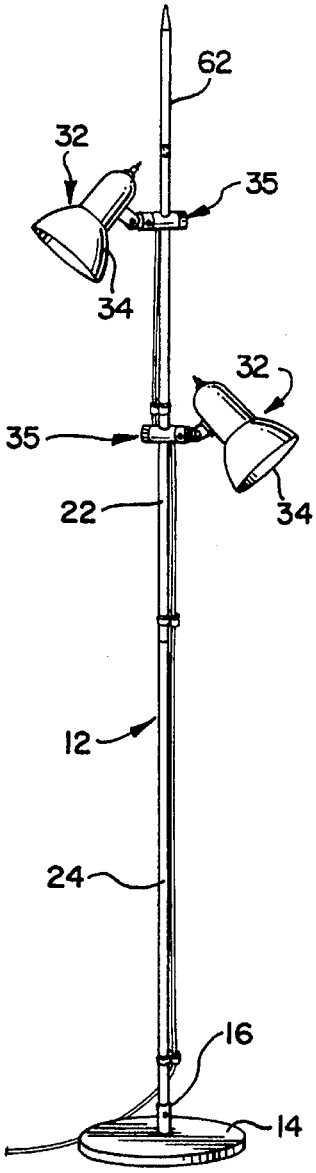
FIG. 3 is a pictorial view of the multipurpose tree lamp after the cap member has been mounted to the upper end of the tree lamp in place of the removed upper pole section.
Figure 5:
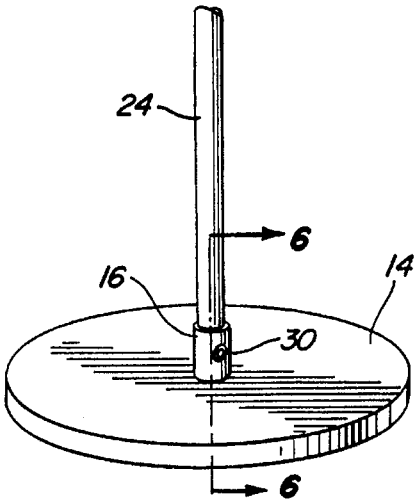
FIG. 5 is a perspective view of the lamp base and the bottom portion of the lamp post.
Figure 6:
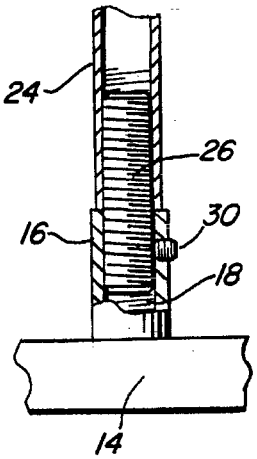
FIG. 6 is an enlarged cross-sectional view taken substantially along line 6—6 of FIG. 5.
Figure 7:
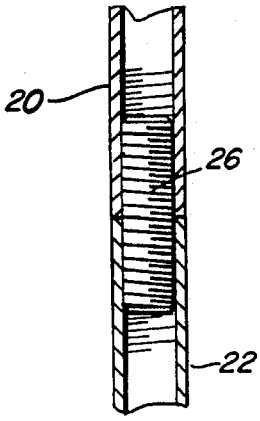
FIG. 7 is an enlarged cross-sectional view of the threaded connection between two pole members of the lamp post.

The first or upper pole section 20 is secured to a second intermediate pole section 22 to which a third or bottom pole section 24 is mounted. Consequently, the second pole section 22 is positioned intermediate the upper or first pole section 20 and the bottom or third pole section 24. The first pole section 20 is secured to the second pole section 20 by means of a threaded pin 26 which is threadably mounted in the attaching end of first pole 20 and the corresponding threaded attaching end of the second pole 22, as illustrated in FIG. 7. Therefore, the upper or first pole section 20 is closed at its distal end 28, as seen in FIGS. 1, 2 and 3. Pin 26 is also positioned in the opposite threaded end of the intermediate pole 22 and one of the two corresponding ends of the bottom or third pole section 22. The lower end of the threaded end of pole section 24 is threadably mounted to nipple 14 and is additionally secured by a set screw 30, as illustrated in FIG. 6.

Multipurpose tree lamp 10 is also adapted to support a plurality of light fixtures, generally indicated at 32. Each light fixture comprises a light housing 34 which includes a typical light socket enclosed therein to receive a light bulb. Since the light socket and light bulb are well known they are not illustrated in the drawings. Light housing 34 is pivotally attached by a bracket 33 to a suitable mounting means, indicated generally by numeral 35, that allows each light fixture to be positioned along the lamp post 12.

Figure 8:
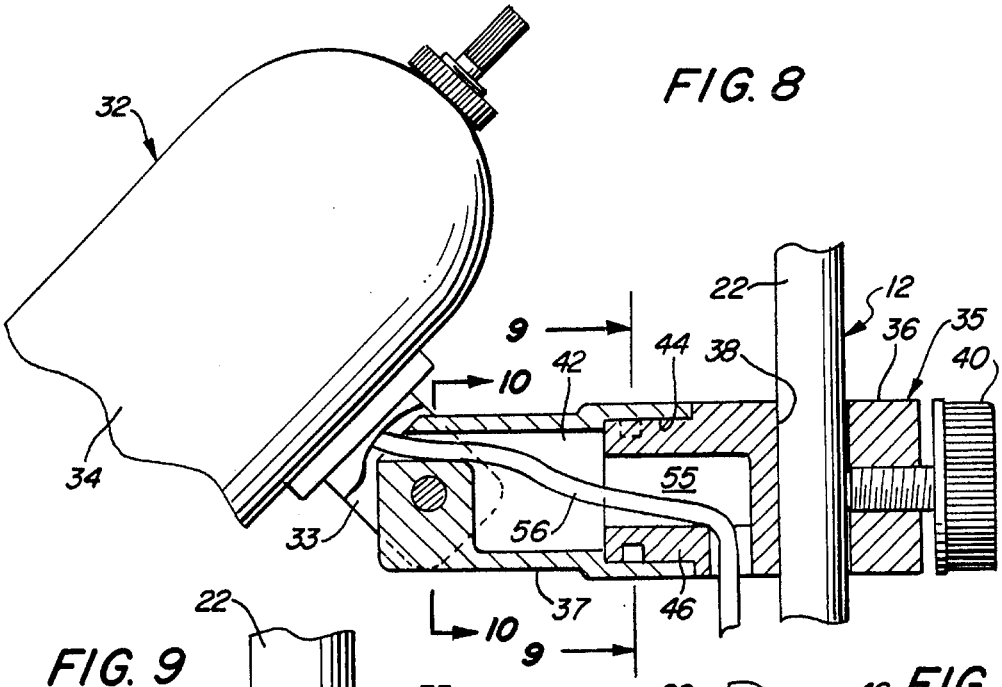
FIG. 8 is an enlarged longitudinal cross-sectional view of the adjustable mounting clamp for the light fixtures.

Mounting means 35 comprises a body mount member 36 that includes a swivel head 37 to which is adjustably attached the light housing 34. Body mount member 36 is formed with a bore 38 that is adapted to receive a pole section therein, whereby the light fixture can be selectively positioned along post 12 by locking means that includes a hand operated set screw 40 which is threadably mounted in the body mount member so as to be tightened to engage against the pole, as shown in FIG. 8.

Figure 9:
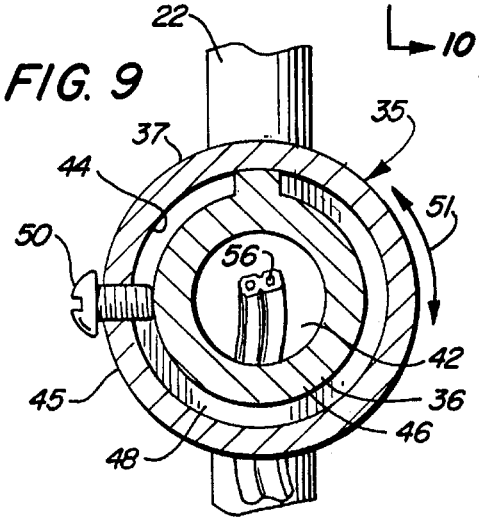
FIG. 9 is an enlarged cross-sectional view of the adjustable mounting clamp taken substantially along line 9—9 of FIG. 8.
Figure 10:
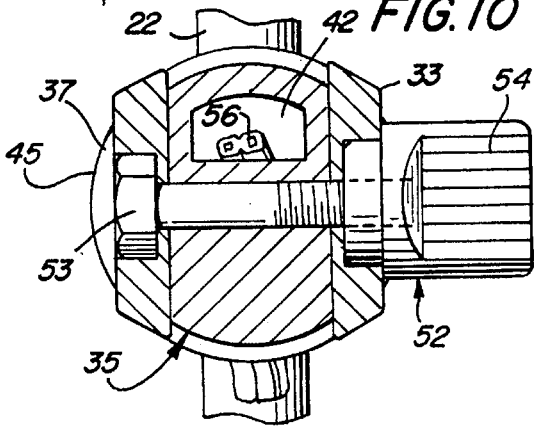
FIG. 10 is an enlarged cross-sectional view of the adjustable mounting clamp taken substantially along line 10—10 of FIG. 8.

Swivel head 37 is formed as a rotatable housing that defines a passage 42 and an enlarged annular recess 44, wherein the recess is adapted to rotatably receive a matching extended neck member 46 formed on the distal end of body mount member 36. Neck member 46 includes an annular channel 48 in which an adjusting screw 50 is received and is mounted to the annular wall 45 of recess 44, as illustrated in FIG. 9, and wherein arrow 51 indicates the direction of rotation of swivel head 37. Light housing 32 is adjustably attached to the swivel head 37 by a keeper means 52 defined by a bolt 53 and nut 54, as shown in FIG. 10.

Accordingly, it should be noted that body mount member 36 is also provided with a passageway 55 formed to receive an electrical wiring means 56 that is operably connected at one end to the respective light sockets as it enters each light housing 32, and wherein the opposite end of wire 56 is provided with a typical electrical plug not shown. Each light fixture includes its own wire and is arranged to be disposed outwardly of the pole sections to allow said light fixtures to be individually adjusted or removed from the lamp post. However, two or more light fixtures can be interconnected by a single wire. The light fixture mounted on the upper or first pole section 20 is provided with its own separate wire that can be readily removed from the lamp post as will hereinafter be described.

Referring more particularly now to FIGS. 2, 3 and 4, there is illustrated a novel method of creating a separate and distinct table lamp, as illustrated in FIG. 4, by rearranging the basic multipurpose tree lamp as shown in FIG. 1 to that as illustrated in FIG. 3. That is, when the disassembled multipurpose tree lamp is to be assembled one may construct the single multipurpose lamp structure of FIG. 1 by using all of the specific components to connect the three pole sections 20, 22 and 24 as described above, and mounting the formed lamp post to the base member 14. Or one can assemble two separate and independent lamp structures, that being the floor lamp as illustrated in FIG. 3, and the floor lamp shown in FIG. 4. The disassembled multipurpose tree lamp is provided with a second base member, as indicated at 60 in FIG. 4, and an extended cap member 62. The extended cap member 62 can be any suitable length when used to replace the first pole section 20, whereby the opened end of the second pole section 22 is capped off when the first pole section 20 is not used with the tree lamp.

In FIG. 2 the first pole section 20 is shown together with cap 62 as being disconnected from pole 22 so as to indicate that either pole 20 or cap 62 can be readily mounted to the internally threaded bore of pole 22. Thus, it can be readily understood that one can construct the multipurpose floor lamp as indicated in FIG. 1, wherein all three pole section 20, 22 and 24 are employed together with three light fixtures. Or one can construct the floor lamp as illustrated in FIG. 3, wherein the floor lamp employs only two pole sections 22 and 24, pole section 22 being used to cap off pole section 22 by means of cap member 62.

Referring now to FIG. 4, there is shown a lamp, indicated generally at 65, wherein first pole section 20 and one lamp fixture 32 is shown being mounted on second base member 60 so as to define a separate table lamp from the original multipurpose tree lamp 10.

In summary, the multipurpose tree lamp 10 allows its structural components to be employed to provide a single floor lamp, as illustrated in FIG. 1, or to be constructed, as illustrated in FIGS. 3 and 4, to create two separate and individual lamps, one being assembled as a floor lamp and the other being assembled as a table lamp as described above.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What I claim is:

1. A method of forming a multipurpose tree lamp comprising the steps of:

mounting a lamppost on a base member wherein said lamppost is formed with at least three pole sections defined respectively as first, second and third pole sections;

interconnecting said first pole section formed with one open threaded end to one end of said second pole section formed with oppositely open threaded ends;

positioning a plurality of light fixtures on said lamppost by an adjustable mounting means;

forming a second lamp from said multipurpose tree lamp, comprising the steps of:

removing said first pole section from said lamppost and replacing said first pole section with an extended cap member;

removing one of said light fixtures with said first pole section;

mounting said first pole section to a second base member; and positioning said light fixture on said first pole section to define a table lamp.

2. The method of forming a multipurpose tree lamp as recited in claim 1, including the steps of:

connecting an electrical wire to each of said light fixtures, whereby each of said light fixtures is adjustably positioned independent of each other; and extending said electrical wire through said adjustable mounting means, whereby said wire is positioned outside of the pole sections.

3. The method of forming a multipurpose tree lamp as recited in claim 2, including the further steps of:

attaching said light fixture to said adjustable mounting means which comprises a body mount and a swivel head that is rotatably mounted to one end of said body mount;

securing said adjustable mounting means on said body mount so as to fixedly engage said pole section by a locking means;

securing said light fixture to said swivel head; and rotating said swivel head to arrange and position said light fixture about said body mount.

* * * * *